United States Patent [19]

Ruterbusch

[11] Patent Number: 4,706,171

[45] Date of Patent: Nov. 10, 1987

[54] CONTAINMENT SHIELD FOR A REPLACEABLE XENON LAMP AND REFLECTOR MODULE

[75] Inventor: Paul H. Ruterbusch, Liverpool, N.Y.

[73] Assignee: General Electric Company, Princeton, N.J.

[21] Appl. No.: 900,109

[22] Filed: Aug. 25, 1986

[51] Int. Cl.[4] ..... F21V 19/04

[52] U.S. Cl. ..... 362/254; 362/321

[58] Field of Search ..... 362/303, 319, 321, 254, 362/457; 353/85, 87; 355/67; 313/237

[56] References Cited

U.S. PATENT DOCUMENTS

| | | | |
|---|---|---|---|
| 3,642,361 | 2/1972 | Streu | 353/87 |
| 4,156,891 | 5/1979 | Roche | 362/254 |
| 4,195,331 | 3/1980 | Jones | 362/267 |

*Primary Examiner*—Larry Jones
*Assistant Examiner*—Noah Kamen
*Attorney, Agent, or Firm*—Eugene M. Whitacre; Vincent J. Coughlin, Jr.

[57] ABSTRACT

A containment shield for a replaceable Xenon lamp and reflector module provides a safe, simple means of replacing and handling an arc lamp (10) for a light valve projection system. Guides (93, 94) are provided which act as a means of positioning and allowing easy removal of a lamp module (97). These guides also provide the mounting structure for a spring (112) that locks the lamp module into the guides to prevent removal unless the containment shield or shutter (91) is on and the means for releasing the shutter once the lamp module is in place. A shutter release screw (110) is locked into its mounting bracket to prevent its total removal. This insures that the screw will be there to release a shutter and not be removed or lost. The lamp module itself is composed of a rectangular mount plate (99) which provides the support for the arc lamp (10), reflector (100) and other components. This mount plate has a base bracket (103) attached to the bottom of the plate which acts as a means of holding the bottom of the shutter in place on the lamp module, while also providing a bottom seal to the system. The mount plate also has two pins (104, 105) located on each side of the plate to provide positioning of the shutter while on the lamp module assembly. A hole (106) cooperates with a spring (108) to form a locking mechanism for holding the shutter in place.

4 Claims, 11 Drawing Figures

FIG. 8
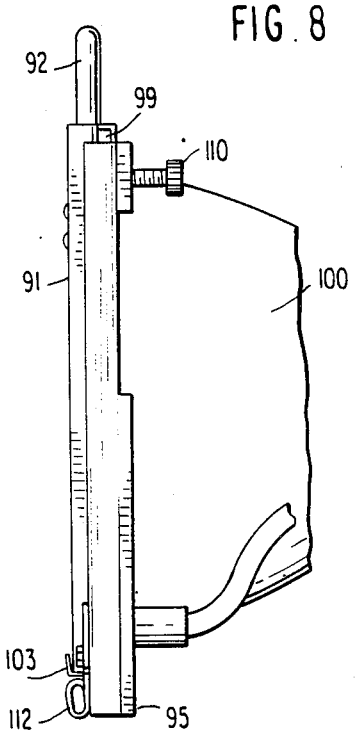
FIG. 9
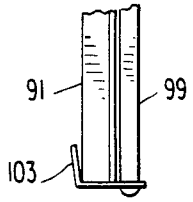
FIG. 10
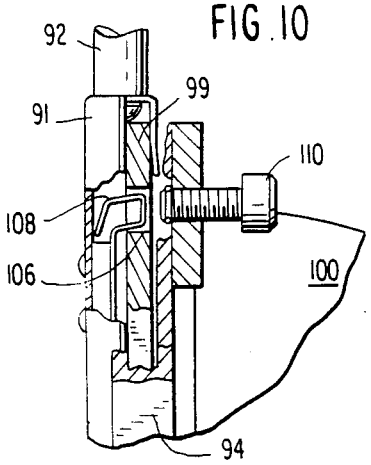
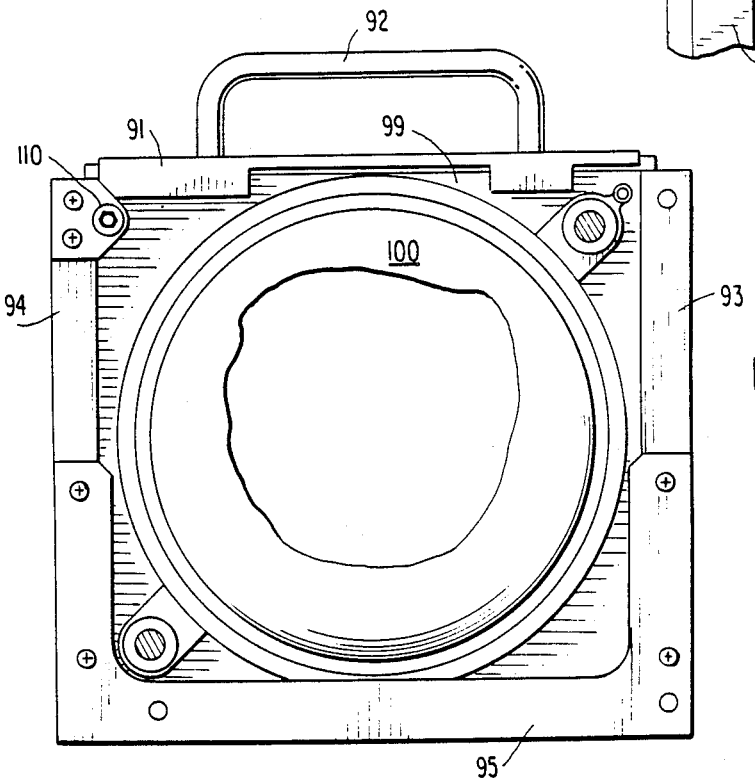
FIG. 11

CONTAINMENT SHIELD FOR A REPLACEABLE XENON LAMP AND REFLECTOR MODULE

BACKGROUND OF THE INVENTION

1. Field of the Invention

The present invention generally relates to improvements in light valve projection systems of the Schlieren dark field type and, more particularly to a containment shield, or shutter, for explosion protection of a replacement Xenon lamp and reflector module for such light valve projection systems.

2. Description of the Prior Art

Light valve projection systems of the Schlieren dark field type have been in commercial use for many years and are capable of providing excellent performance. Typical prior art color projection systems of this type are shown in U.S. Pat. Nos. 3,290,436, 3,352,592 and 3,437,746, all of which were issued to W. E. Good et al. The principles of operation of this type of projection system are briefly described with reference to FIGS. 1, 2 and 3 of the drawings.

With reference first to FIG. 1, there is schematically shown a single-gun television light valve assembly comprising a lamp 10, sealed light valve 12, and Schlieren projection lens 14. The sealed light valve 12 comprises a glass envelope which contains an electron gun 16, input slots 18, focus-deflection system 20, a control layer 32 on a rotating disk 22, and a fluid reservoir 24.

The electron gun 16 generates, from anode aperture 11, an electron beam which is used to "write" charge patterns on the control layer 32. These patterns create surface deformations in the layer and form light diffraction gratings. The electron beam is focused, deflected, and modulated by electrodes 23, 25, 27, and 21. The control layer surface deformations diffract and modulate the light rays passing through the layer 32 and disk 22.

The focus-deflection system 20 comprises three electrode sets each having four orthogonal electrodes, which form three electrode "boxes", referred to as boxes 23, 25 and 27, and a cylindrical electrode 21. The first of these, box 23, is arranged about the aperture in the input window and serves to center and allow predeflection of the electron beam. The next two boxes, boxes 25 and 27, have DC and AC voltages applied to them in a manner to achieve a uniformly focused electron beam image of aperture 11 which is scanned across the raster plane on control layer 32. This, in turn, permits the control layer fluid to be modulated uniformly by charge control to produce a uniformly colored projected image. Following the focus-deflection boxes 25 and 27 is a drift ring 21 which serves, with a transparent electrode on disc 22, as an element of the final electron lens in the focus-deflection system 20.

Specific examples of light modulating fluids are disclosed in U.S. Pat. No. 3,288,927 to Ralph W. Plump, U.S. Pat Nos. 3,317,664 and 3,317,665 both to Edward F. Perlowski, Jr., U.S. Pat. No. 3,541,992 to Carlyle S. Herrick et al, and U.S. Pat. No. 3,761,616 issued to C. E. Timberlake. These fluids may include additives as taught by U.S. Pat. Nos. 3,764,549 and 3,928,394 to David A. Orser. In general, the control layer or light modulating fluid is a very special chemical compound, modified with special additives, having the electromechanical and visco-elastic properties needed to produce effective control layer properties in the electron beam addressed light valve.

The basic light collection system includes an arc lamp 10, which may be a Xenon lamp, the arc of which is located at the focus of a reflector system, which may be a simple ellipsoidal reflector, as shown, or a compound reflector, as disclosed for example in U.S. Pat. No. 4,305,099 to Thomas T. True et al. The light from the arc is reflected from the reflector through a pair of spaced lens plates having corresponding pluralities of rectangular lenticules arranged in horizontal rows and vertical columns. The first lens plate is shown in FIG. 1 at 28 and the second lens plate is formed on the light input surface of the glass envelope of the light valve 12. The light from the lamp 10 is projected through a color filter plate 26 and the lenticular lens 28 before entering the light valve 12.

The interior surface of the glass envelope of the light valve 12 carries the input light mask in the form of slots 18 which, for example, may be applied by vapor deposition. The input slots 18 are a series of transparent slots and alternating opaque bars in a pattern generally as indicated in FIG. 1. The filtered light rays from the lamp 10 pass into the light valve 12 through these transparent slots. The lenslets of the lenticular lens 28 and the corresponding lenslets, formed on the light input surface of the glass envelope of the light valve 12, form condensing lens pairs which first focus spots of filtered light onto the slots of the light mask and then re-image the light rays onto the control layer raster plane 32. With this arrangement, efficient utilization is made of light from the arc lamp, and uniform distribution of light is produced, in a rectangular pattern, on the light modulating medium or control layer 32.

The Schlieren projection lens 14 includes Schlieren lens elements 29, output color selection bars 30 and a projection lens system 31. The output selection bars 30 are the complement of the input slots 18. That is, on the output bar plate, the bars are optically aligned with the slots of the input slots 18 so that, in the absence of a diffraction of light passing through the control layer 32, light rays are focused and terminated on the bars of the output bar plate. This creates a "dark field" condition, i.e., no light is transmitted in the absence of a modulating signal superimposed on the raster scanning signals applied to the horizontal and vertical deflection plates of the deflection system 20. It should be noted, however, that the electron beam which scans the raster and provides charge to the control layer is a constant current electron beam, there being no modulation of the intensity of the beam produced by the electon gun 16 (other than during the horizontal and vertical retrace intervals when the beam is off).

The lower half of FIG. 1 shows the cross sections of the light body and light valve components. The spectral diagrams at the bottom indicate how the light is prefiltered before entering the light valve.

FIG. 2 is a simplified light valve diagram showing the color selection action of the three basic gratings. The control layer 32 which is supported by the rotating disk 22 (shown in FIG. 1) is illustrated as having three different diffraction gratings for red, green and blue light components. These diffraction gratings may be written individually or simultaneously and normally are actually superimposed but, for purposes of illustration only, they are shown in FIG. 2 as separated on the control layer 32.

In the light valve projection system shown in FIGS. 1 and 2, green light is passed through the horizontal slots of the input bar plate 18 and is controlled by diffraction gratings formed by modulating the height of the scanned raster lines on the control layer 32. This is done by controlling the amplitude of a high frequency carrier applied to the vertical deflection plates as modulated by the green video signal as shown in FIG. 3. Magenta (red and blue) light is passed through the vertical slots of the input bar plate 18 and is controlled by charge generated diffraction gratings created at right angles to the raster lines by velocity modulating the electron spot as it is scanned in the horizontal direction. In the example shown in FIG. 3, this is done by applying a 16 MHz (12 MHz for blue) signal to the horizontal deflection plates and modulating it with the red video signal as shown in FIG. 3. The grooves created in the control layer 32 have the proper spacing to diffract the red portion of the spectrum through the vertical output slots in plate 30 while the blue portion is blocked. (When the 12 MHz carrier is used, the blue light is passed by the vertical slots in plate 30 and the red light is blocked.)

Thus, three simultaneous and superimposed primary color pictures can be written with the same electron beam and projected to the screen 33 as a completely registered full color picture. Colors are created by writing minature diffraction gratings within each picture element on the fluid surface by manipulating the single scanning electron beam. These gratings diffract the transmitted light rays away from their terminations at the output bars where they are spatially filtered to let the desired color reach the screen. The amount of light diffracted is dependent on the depth of the gratings formed in the control layer. This technique permits a full color television picture to be written on a single control layer with no need for further registration.

FIG. 3 shows in block diagram form the basic light valve projector circuitry. A composite video signal is supplied to the input of a decoder 34 which provides at its output red, blue and green video signals. These signals are respectively applied to modulators 36, 38 and 40. A grating generator 42 supplies carrier signals which, in the case illustrated, have frequencies of 16 MHz and 12 MHz, respectively, to modulators 36 and 38 and a signal having a frequency of 48 MHz to modulator 40. The outputs of the red and blue modulators 36 and 38 are combined and superimposed on the horizontal deflection signal from the horizontal deflection signal generator 44. The output of the green modulator 40 is superimposed on the vertical deflection signal from the vertical deflection generator 46.

The basic Schlieren dark field light valve projector as schematically illustrated in FIGS. 1, 2 and 3 has evolved over a period of years to be a highly efficient projector producing excellent quality pictures of good color balance and high resolution.

It is desirable to have a customer replaceable, prealigned Xenon lamp and reflector module that can be safely removed, transported and installed into a projector of the type described. The difficulty arises from the need to provide safe handling of a Xenon lamp type system and to address the potential explosion hazard that exists with any pressurized lamp. In order to handle a Xenon lamp and reflector module without the need for elaborate safety protection and to prevent exposure of a person or persons to the possible hazards of a Xenon lamp explosion, it is necessary that a replaceable module possess an explosion containment device that is attached and locked onto the module before it is removed from a projector system. The explosion containment device must also be part of the module during installation of the new module. The Xenon lamp and reflector module should be a self-contained unit. In the event of an explosion of a Xenon arc tube, the person or persons handling the module should be protected from any flying of glass or particles that may cause injury.

SUMMARY OF THE INVENTION

It is therefore a general object of this invention to provide improvements in the design and manufacture of light valve projection systems of the Schlieren dark field type.

It is another and more specific object of the invention to provide a containment shield for explosion protection of a replaceable Xenon lamp and reflector module for light valve projection systems.

According to the present invention, a containment shield was devised in conjunction with a guide system and Xenon lamp and reflector module to provide a safe, simple means of replacing and handling a projection system containing a Xenon arc lamp. It should be understood that a Xenon arc lamp is used in the preferred embodiments of the light valve projector systems but that other, similar arc lamps may be used depending on the application. Therefore, while reference is made herein to a Xenon arc lamp, it will be understood that the invention is not specifically limited to such lamps.

In the disclosed embodiment, guides are provided which act as a means of positioning and allowing easy removal of the lamp module. These guides also provide the mounting structure for the spring that locks the lamp module into the guides to prevent removal unless the containment shield or shutter is on and the means for releasing the shutter once the lamp module is in place. A shutter release screw is locked into its mounting bracket to prevent total removal. This insures that the screw will be there to release a shutter and will not be removed or lost.

The lamp module is composed of a rectangular mount plate which provides the support for the Xenon arc lamp, the reflector and the other components. This mount plate has a base bracket attached to the bottom of the plate which acts as a means of holding the bottom of the shutter in place on the lamp module. The base bracket also provides a bottom seal or containment to the system in the event of a lamp explosion. The mount plate also has two pins located on each side of the plate to provide positioning of the shutter while on the lamp module; that is, it prevents the shutter from sliding sideways and coming off. There is also a hole in the upper right hand corner of the plate (when viewed from the front) which acts as the locking mechanism for holding the shutter in place via a spring located as part of the shutter assembly.

The containment shutter is specially shaped to work in conjuction with the guides and lamp module to provide effective explosion protection for anyone handling the system. A spring within the shutter locks the shutter in place on the lamp module.

BRIEF DESCRIPTION OF THE DRAWINGS

The foregoing and other objects, aspects and advantages of the invention will be better understood from the following detailed description with reference to the drawings, in which:

FIG. 8 is a side view of the structure shown in FIG. 6;

FIGS. 9 and 10 are enlarged views of portions of the structure shown in FIG. 8; and FIG. 11 is rear plan view, partially broken away, of the structure shown in FIG. 6.

DETAILED DESCRIPTION OF THE PREFERRED EMBODIMENT OF THE INVENTION

Figure 4:
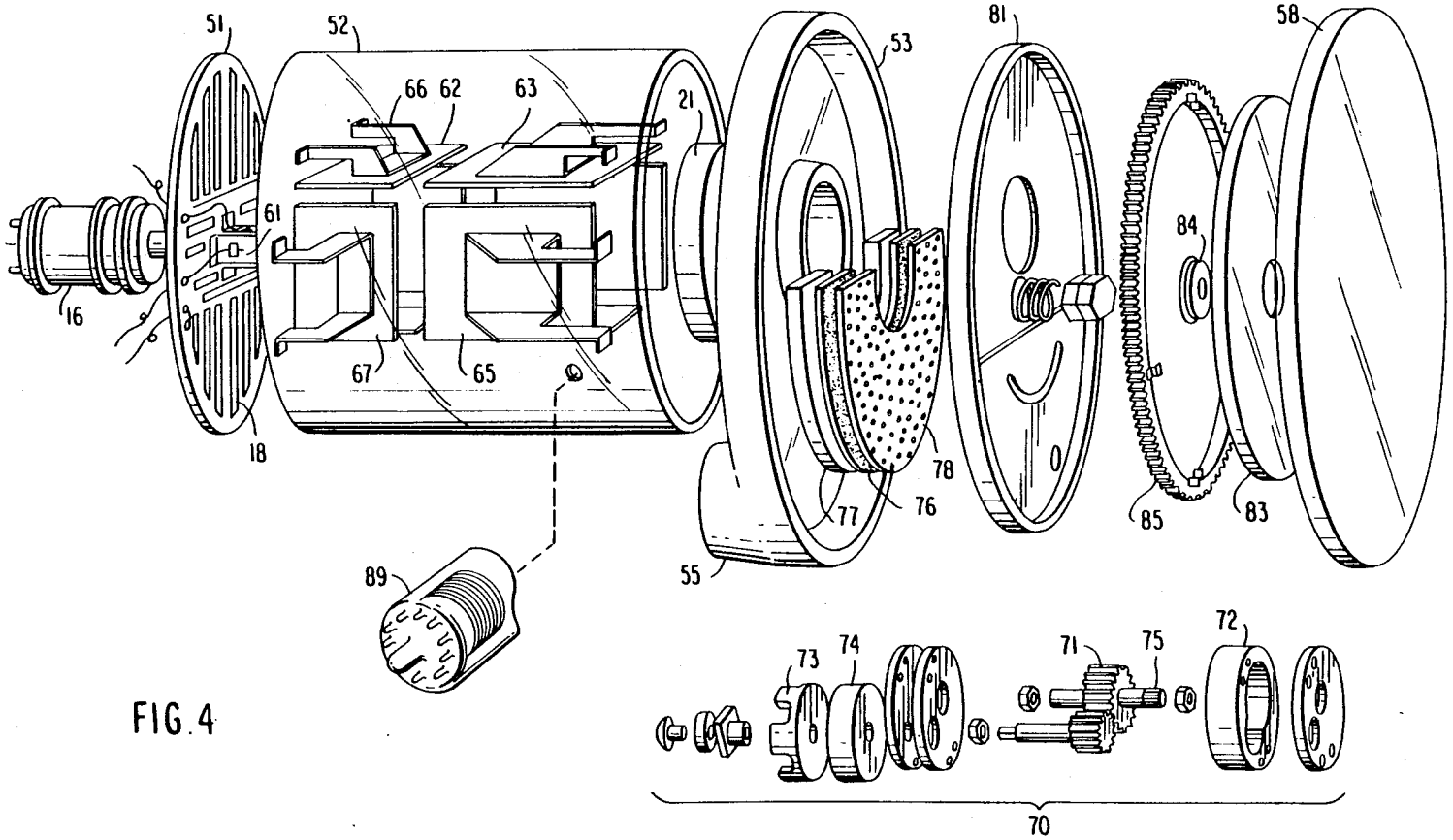
FIG. 4 is an exploded prespective view of major elements of a new generation of light valves which embody the invention.

In the drawings, like reference numerals used in the several figures indicate the same or corresponding components. Referring again to the drawings, and more particularly to FIG. 4, there is shown an exploded view of the internal vacuum components of the new generation Schlieren dark field light valves. The vacuum enclosure comprises an input window 51, a focus deflection cylinder 52, a rear housing 53 which has a molded recess 55 for receiving a pump assembly 70, and a face plate 58. The electron gun assembly 16 is attached to a central aperture of the input window 51, and the input slots or bar plate 18 are formed on the interior surface of the input window 51, functionally similar to the earlier light valves of this type.

The focus and deflection assembly comprises three sets of electrodes. One set of four electrodes 61, comprising a pair of horizontal plates and a pair of vertical plates, is attached to the input window 51 about its central aperature. A pair of vertical deflection plates 62 and a pair of horizontal deflection plates 67 located within the cylinder 52 form the second set. The third set is comprised of the vertical deflection plates 63 and the horizontal deflection plates 65. As shown in FIG. 4, the deflection plates 62, 63, 65, and 67 are supported within the cylinder 52 by means of brackets 66 which also provide the electrical connections to the deflection plates. Beyond the deflection plates 63 and 65 and within the rear housing 53 is a cylindrical drift ring 21 which, with a transparent electrode on disc 83, completes the focus-deflection system.

A gear pump assembly, generally indicated at 70, is located within recess 55 of the rear housing 53. The gear pump comprises gears 71 within a housing 72 driven by a magnet 73. The magnet 73 is coupled to a rotating magnet driven by an electric motor (not shown) axially aligned with the pump 70 on the exterior rear face of the recess 55 that houses the pump. An axial shield 74 is provided for the magnet 73 so that its magnetic field does not affect the electron beam. Other magnetic shielding is provided within the light valve projection system to prevent the electron beam from being affected by magnetic fields at the projector or due to the earth's magnetic field.

Figure 1:
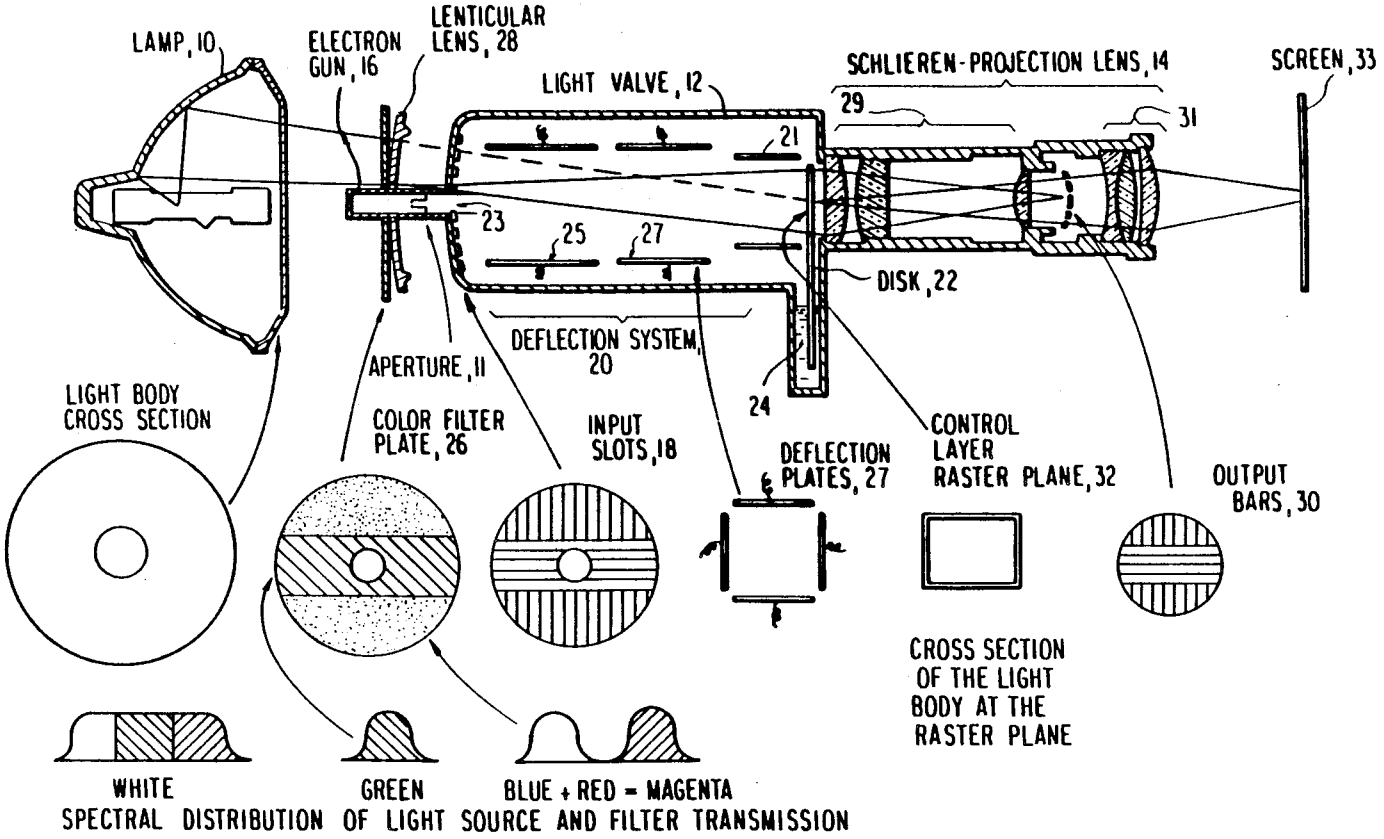
FIG. 1 PRIOR ART
FIG. 1 is a simplified cross-sectional view showing the construction of a prior art light valve projection system.
Figures 2, 3:
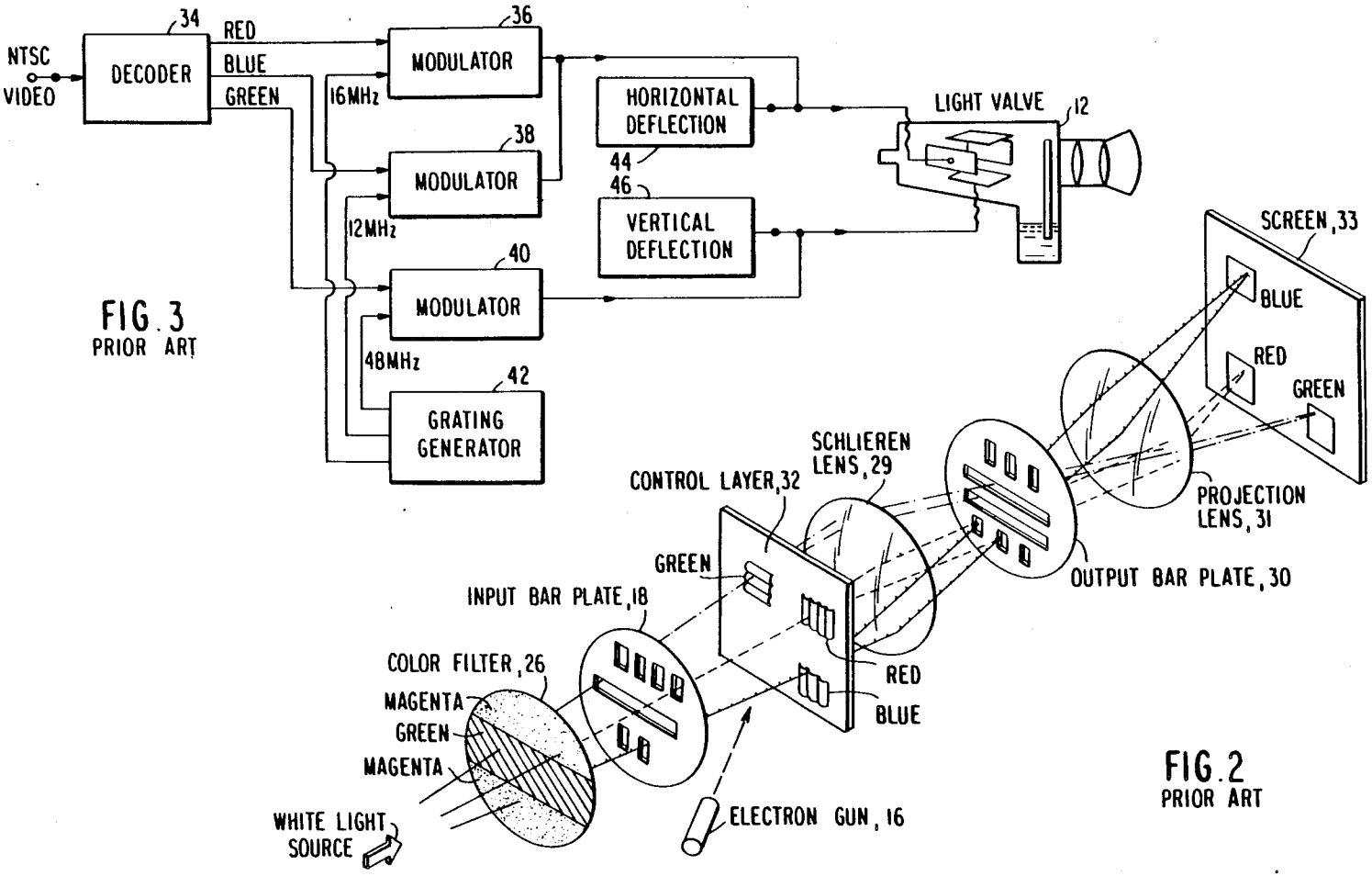
FIG. 2 PRIOR ART
FIG. 3 PRIOR ART
FIG. 2 is a simplified prespective view illustrating the principles of operation of the prior art light valve projection system.
FIG. 3 is a block diagram showing the basic circuitry of a modulated deflection system of the prior art light valve projection system.

The rear housing 53, including the recess 55 which houses the pump assembly 70, and the face plate 58 generally define the fluid reservoir 24 (schematically illustrated in FIG. 1) which contains the light modulating fluid. The gear pump 70 is located in that reservoir and operates to pump the fluid through a filter 76. The filter 76 is sandwiched between a filter housing 77 and a perforated panel 78, and this assembly is secured to the lower rear face of a baffle 81. The baffle 81 is a generally circular disk with a forwardly projecting flange which surrounds the rotating disc 83. The disc 83 is supported for rotation by a bearing 84 through which projects a pin mounted in the center of baffle 81. A ring gear 85 is attached to the peripheral edge of the disc 83 and is driven by a pinion gear 75 that projects from the gear pump 70.

Attached to the side of the cylinder 52 is a vacuum maintenance device 89, which collects gaseous materials remaining in the envelope after it is sealed and which are generated as a product of the operation of the light valve.

Referring now to FIGS. 5 to 11, there is shown a containment shutter and replaceable xenon lamp and reflector module according to the present invention. The containment shutter 91 having a handle 92 and the replaceable lamp and reflector module 97, which are secured together as described hereinafter, are received in the grooves of guides 93 and 94. The guides 93 and 94 are positioned in spaced relation by a U-shaped bracket 95. The guides 93 and 94 and the U-shaped bracket 95 constitute a guide assembly which is attached to the rear of a light valve projector system. Within the grooves of the guides 93 and 94 are leaf springs to provide a frictional bias to the engaging edges of a mount plate 99 of the lamp module 97. One of these leaf springs can be seen within the groove of guide 93 in FIG. 5.

Figure 5:
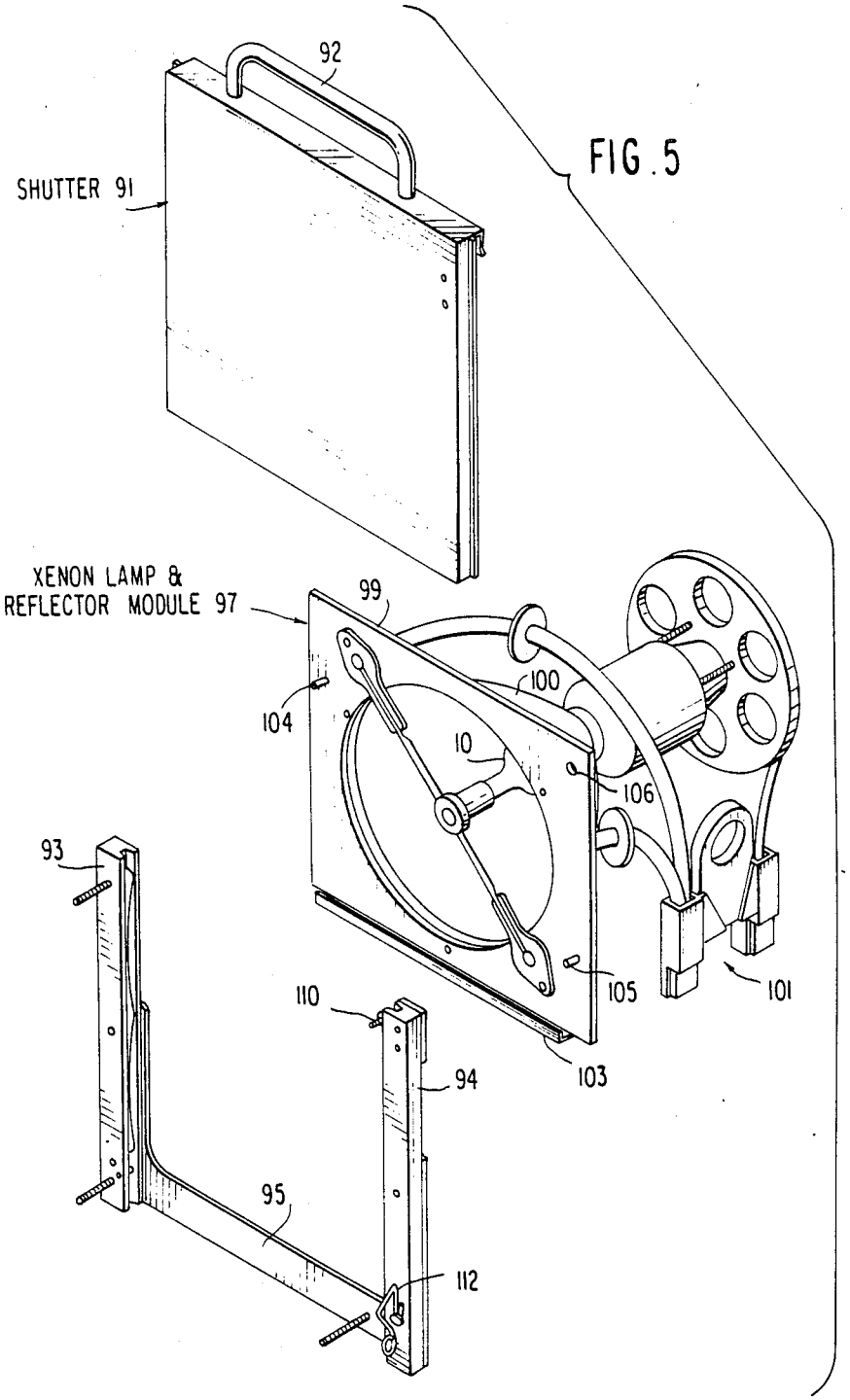
FIG. 5 is an exploded view of the principle parts of a replaceable modular light source and containment shutter according to the present invention.

The lamp module 97 is composed of the rectangular mount plate 99 which provides support for the Xenon arc lamp 10, the reflector 100 and the other components including an electrical connector 101. The lower edge of the mount plate 99 is provided with a base bracket 103. As best shown in FIGS. 5 and 9, the base bracket 103 has a flange for holding the bottom of the shutter 91 in place on the lamp module 97. When the shutter 91 is slid into the grooves of the guides 93 and 94, the flange of the base bracket 103 (see FIG. 9), which receives the shutter 91, acts as a seal or containment for the lamp module in the event of an explosion.

The mount plate 99 also has two pins 104 and 105 on each side of the plate to provide positioning of the shutter 91 while on the lamp module 97. These pins, 104 and 105, prevent the shutter 91 from sliding sideways and coming off the lamp module 97. There is also a hole 106 in the upper right of the mount plate 99 as best shown in FIG. 5, which is used with a locking mechanism, shown in FIG. 10, to lock the shutter 91 in place. The locking mechanism comprises a spring 108 which, when the shutter is slid all the way down into the guides 93 and 94, projects through the hole 106 in the mount plate 99. In order to release the shutter, a release screw 110 is screwed into the hole 106 forcing the spring out and allowing the shutter to be withdrawn. At the same time, the release screw 110 secures the lamp module 97 to the guide assembly.

From the description thus far, it will be appreciated that the shutter 91 cooperates with the reflector 100 to form an effective containment vessel for the Xenon lamp 10. In operation, with the shutter already locked onto a lamp module 97, the shutter 91 and the mount plate 99 are slid all the way down into the guides 93 and 94. To remove the shutter, the shutter release screw 110 is screwed into hole 106 as far as it will go to release the spring 108. This locks the lamp module 97 to the guide assembly and allows the shutter 91 to be withdrawn by pulling on the handle 92.

Figure 6:
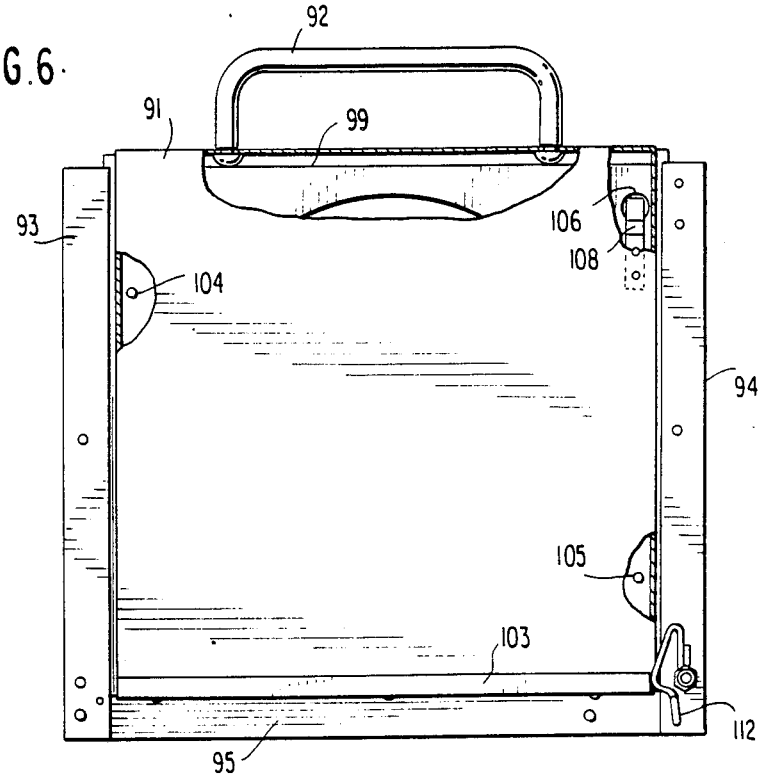
FIG. 6 is a front plan view of the shutter locked to a lamp module.
Figure 7:
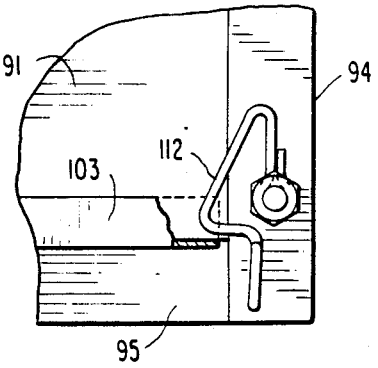
FIG. 7 is an enlarged view of a portion of the structure shown in FIG. 6.

As best shown in FIGS. 6 and 7, when the shutter 91 is slid upwards in guides 93 and 94, spring 112 expands to engage the flange projecting from the base bracket 103 of the mount plate 99 thereby preventing the lamp module 97 from being removed from the guides 93 and 94, even if someone tried to remove the module by loosening the shutter release screw 110 that was holding the module down during shutter removal.

Replacement of the lamp module 97 is accomplished by first backing out the shutter release screw 110. Then the shutter 91 is slid into the guides 93 and 94 and pressed firmly downward so that locking spring 108 enters the hole 106 thereby locking the shutter to the lamp module 97. At the same time, spring 112 is biased into its release position by the shutter 91 so that the lamp module 97 with the shutter 91 locking in place may be withdrawn from the guide assembly.

The invention provides a safe, easily replaceable, pre-aligned Xenon lamp module that eliminated the need for any customer alignment of the lamp module to the light valve projector when replacing a spent lamp module. The guide assembly which is attached to the projector is pre-aligned at the factory to give maximum light output. Once the guides are optimized to the particular projector, lamp modules having a Xenon arc tube pre-aligned to the reflector can be removed and replaced without the need for any further adjustments.

While the invention has been described in terms of a single preferred embodiment, those skilled in the art will appreciate that the invention can be practiced with various modifications within the spirit and scope of the appended claims.

Having thus described my invention, what I claim to be new and desire to secure by Letters Patent is as follows:

1. In an image projection system which uses an arc lamp and reflector as a light source, wherein the improvement comprises:

guide assembly on said projection system, said guide assembly including a pair of parallel guide members with facing grooves;

a replaceable lamp module including mount means for supporting said arc lamp and reflector, said mount means being removably received by said facing grooves;

a containment shutter for selective mating engagement with said mount means, said shutter including first locking means for releasably securing said shutter to said mount means; and second locking means on said guide assembly for automatically engaging said mount means of said module upon the withdrawal of said shutter from said grooves, said second locking means being released upon the insertion of said shutter into said grooves and the engagement of said first locking means, thereby allowing the withdrawal of said module with said shutter in mating engagement with said mount means.

2. The image projection system recited in claim 1 wherein said mount means comprises a mount plate which includes a projecting base member along the bottom edge thereof, and said second locking means includes a spring attached to said guide assembly and released by the withdrawal of said shutter to engage said base member and lock said mount plate of said module to said guide assembly, said spring being depressed to release said module when said shutter is inserted and pressed fully into said guide assembly.

3. The image projection system recited in claim 2 wherein said first locking means includes a hole in said mount plate, a locking member attached to said shutter which automatically projects into said hole when said shutter is fully pressed into said guide assembly to lock said shutter to said module, and release means attached to said guide assembly for retracting said locking member from said hole to permit withdrawal of said shutter from said guide assembly.

4. The image projection system recited in claim 3 further comprising positioning means on said mount plate for positioning said shutter as it is inserted into or withdrawn from said guide assembly.

* * * * *